US005199894A

United States Patent [19]

Kalny et al.

[11] Patent Number: 5,199,894

[45] Date of Patent: Apr. 6, 1993

[54] SELF-LOCKING CONNECTOR

[76] Inventors: Lou E. Kalny, 917 Sequoia Ct., San Dimas, Calif. 91773; Frederick B. B. Baumann, 3454 N. Mills, Claremont, Calif. 91711

[21] Appl. No.: 627,647

[22] Filed: Dec. 14, 1990

[51] Int. Cl.[5] ..... H01R 13/623

[52] U.S. Cl. ..... 439/321; 285/82; 439/320

[58] Field of Search ..... 439/312-323; 285/81-93; 403/342, 320, 328; 411/143-145

[56] References Cited

U.S. PATENT DOCUMENTS

| | | | |
|---|---|---|---|
| 3,917,373 | 11/1975 | Peterson | 439/321 |
| 4,034,788 | 7/1977 | Melone | 411/144 |
| 4,502,748 | 3/1985 | Brush, Sr. | 439/313 |
| 4,506,942 | 3/1985 | Flederbach | 285/82 |

FOREIGN PATENT DOCUMENTS

| | | | |
|---|---|---|---|
| 2127234 | 4/1984 | United Kingdom | 439/321 |

OTHER PUBLICATIONS

"9816"; Matrix Science Corp.; Torrance, CA; 1 p.; no date.

"MT37K"; Matrix Science Corp.; Torrance, CA; 1 p.; no date.

"MIL-STD-1553 Data Bus Connectors"; BR Intec Corporation, Pyle-National Division, Chicago, IL; pp. 1-4, 12; Jul., 1987.

"Tri-Start Connector"; Bendix Electric Components Division; Sidney, NY; cover, inside front cover, pp. 1-2; Jan., 1981.

"MIL-C-38999 Series III Connectors"; Pyle-National Division, Chicago, IL; pp. 1-3, 16; Jan., 1985.

"MIL-C-38999/26D Military Specification Sheet"; 3 pp.; May 7, 1990.

*Primary Examiner*—Neil Abrams

*Attorney, Agent, or Firm*—Sheldon & Mak

[57] ABSTRACT

Disclosed is a system for locking and unlocking a connector pair having a threaded clamping nut or ring that is rotatably coaxially supported on a first shell body for holding connector contacts in axial engagement. A multiplicity of first detent members angularly fixed relative to the clamping ring engage a corresponding multiplicity of second detent members fixed to the first shell body, and a cone-shaped spring washer axially holds the members in facing engagement, whereby a total surface contacting area of engagement between the detent members is at least 0.1 times the product of an average engagement pitch diameter and the width of engagement. The first and second detent members can engage at shallow contact angles of not more than about 40 degrees. The spring washer contacts the first detent ring, which can axially slidably engage an engagement surface fixed to the clamping ring, along a continuous annular contact path for uniform axial biasing of the detent members. The connector preferably includes an adjustment ring threadingly engaging the clamping ring for adjustably preloading the spring washer. The clamping ring is preferably axially movable relative to the first shell body between open and closed positions having associated spring biasing levels that contribute positively to an overall clamping force between mating connector portions. Preferably the connector also includes a resilient O-ring members frictionally connecting the clamping ring and the first shell body for dampening vibrations therebetween, and for sealingly enclosing the detent members and the spring washer.

12 Claims, 2 Drawing Sheets

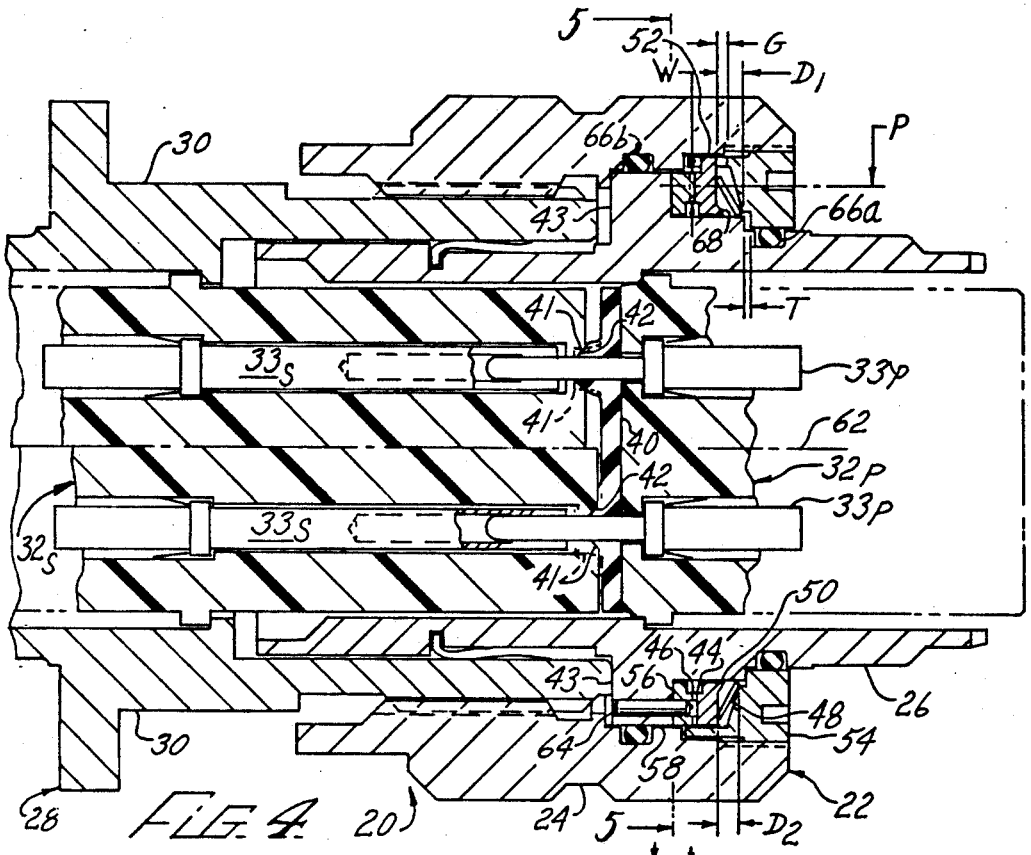
FIG. 4
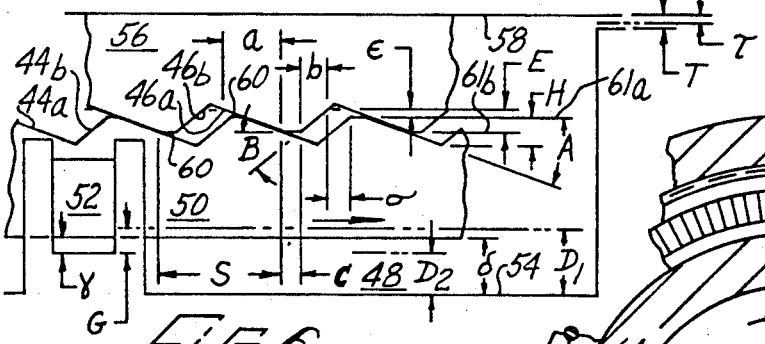
FIG. 6
FIG. 5
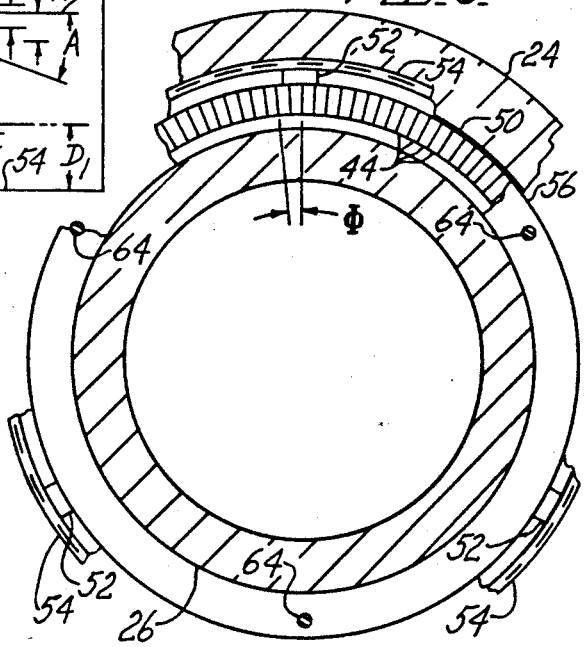

SELF-LOCKING CONNECTOR

BACKGROUND

The present invention relates to electrical connectors that are typically used in high-performance aircraft and other vehicles, that must withstand severe vibration and other adverse environmental conditions.

Connector assemblies for severe environments are typically held in mating engagement by a clamp ring of one connector portion threadingly engaging the mating connector portion. Traditionally, the clamp ring is held in its clamping state by having the ring configured with a single lead thread having a pitch of about 20 threads per inch, and by the use of safety wire. More recently, coarser and/or multiple-lead threads have been preferred for permitting rapid coupling and uncoupling of the assemblies. Connectors of this type include those known as "Series III" connectors that are specified in standard shell sizes 9–25 for many high-performance applications according to MIL-C-38999/26D (dated May 7, 1990), which is incorporated herein by this reference.

When Series III connectors are subjected to heavy vibration, it is required that the mating portions maintain a solid metal-to-metal face contact. It is also required that the performance under vibration be maintained even after a certain minimum number of complete engagements and disengagements of the mating portions. For this purpose, some form of locking device is provided for the clamp ring. With reference to FIGS. 1–3, one form of locking device presently in use includes a set of ratchet teeth 10 that project outwardly from a first shell member 11, one or more detent members 12 being carried on respective spring members 13 by a threaded clamp ring 14 that is rotatably connected to the first shell member 11. Rotation of the ring 14 in a clamping direction (as indicated by the arrow in FIG. 1) for clamping to a second shell member (not shown) is accompanied by ratcheting of the detent members 12 over the teeth 10, the teeth 10 each having a moderately inclined first ramp surface 15 that resists the clamping direction of rotation. Also, each of the teeth 10 has a more steeply inclined second ramp surface 16 that heavily resists rotation of the ring in an opposite, unclamping direction.

The prior art connectors of the type shown in FIG. 1 are subject to one or more of the following disadvantages:

1. The locking device is ineffective in that it does not maintain the required solid metal-to-metal face contact in that the discrete detent positions do not necessarily lie in phase with the fully clamped position of the ring such that even a slight vibration can cause the ring to back off slightly, the face-to-face contact being immediately lost when pressure is released from a compressively loaded elastomer that typically seals contact pins of the connector;

2. The locking device is ineffective in that the detent members do not prevent continued rotation in the unclamping direction, particularly after a number of engagement cycles, because the detent members have very little contact surface area, rapidly wearing away the teeth; and 3. The locking device is unreliable in that harmful foreign matter is not excluded, being damaged when the connector is decoupled, such as when water freezes within the device.

As shown in FIG. 2, a variation of the locking device of FIG. 1 has the detent members 12 formed in pairs that are slightly out of phase for providing detent positions in a multiple of the number of teeth. Each pair of the detent members 12 is located on a multiply supported counterpart of the spring member, designated 13', the spring member 13' rocking slightly on a middle support as indicated at 17 in FIG. 2, one of the detent members 12 moving inwardly as the other moves outwardly between detent positions. The prior art configuration of FIG. 2 suffers from each of the above disadvantages except to the extent that the greater number of detent positions limits the backing off of the clamp ring 14 to the first detent engagement. A further disadvantage of the configuration of FIG. 2 is that it is more expensive and complicated to assemble in that a multiple complement of the detent members 12 is required for obtaining the same locking torque.

As shown in FIG. 3, another variation of the locking device of FIG. 1 has the teeth, designated 10', projecting axially from a counterpart of the first shell member, designated 11'. Several of the detent members (typically four or six), designated 12', are formed on an annular detent plate 18 that has outwardly projecting tabs 18' for keyed engagement with a counterpart of the clamp ring, designated ring 14'. The detent members 12' are axially biased against the teeth 10' by a wavy spring washer, designed spring member 13''. The spring member 13'' is supported within the clamp ring 14' by a first retaining clip 19. A second retaining clip 19' clamps against the first shell member 11' opposite the teeth 10' when the ring 14' is advanced in the clamping direction of rotation.

The prior art configuration of FIG. 3, while failing to overcome the disadvantages of the previously described prior art configurations, has other serious problems. For example, the clamp ring 14' must overcome the axial force from spring member 13'' in addition to the other sources of resistance to clamping of the mating connector portions. Conversely, the spring member 13'' continuously urges the mating portions apart, hastening failure of the connector. Also, the retaining clips 19 are considered to be unreliable, failure of the clip 19' catastrophically rendering the clamp ring 14' completely ineffective in holding the connector in its mated condition. Further, the spring member 13'' makes only spaced apart contact with the detent plate 18, typically at from three to six locations, subjecting the relatively thin plate 18 to undesirable bending deflections between the spaced apart detent members 12' that produce uncontrolled variations in the biasing forces, and possible failure of the detent plate 18 by fatigue.

Thus there is a need for a connector having a locking device that overcomes the above disadvantages.

SUMMARY

The present invention is directed to a system for locking and unlocking a connector pair having a threaded clamping nut. The connector includes a first shell body for receiving a first set of contacts; a threaded clamping ring rotatably coaxially supported on the first shell body for holding the first set of contacts in axial engagement with a second set of contacts; a multiplicity of first detent members supportively coaxially located in a fixed angular relation to the clamping ring; a multiplicity of second detent members supportively coaxially located in a fixed angular relation to the first shell body, the first and second detent members being simultaneously engagable on a detent pitch circle having an average detent pitch diameter P and having a detent engagement width W; and biasing means for axially holding the first and second detent members in facing engagement, whereby a total surface contacting area of engagement between the detent members is at least 0.1 times the product of P and W. The first and second detent members can be engagable in a multiplicity M of equally spaced positions having an angular spacing Φ and an equivalent tangential spacing S, wherein the total surface contact area of engagement is maintained at not less than approximately 0.05 times the product of P and W during rotational movement of the second detent members relative to the first detent members through an angle not less than half of the angular spacing Φ.

The first and second detent members can engage at a first contact angle A between a tangent of the pitch circle and a first surface of contact between each first detent member and a contacting second detent member during rotation of the clamping ring in a clamping direction relative to the first shell body, the angle A being not greater than approximately 30°. Preferably the angle A is not greater than approximately 20°. The first and second detent members can engage at a second contact angle B between a tangent of the pitch circle and a second surface of contact between each first detent member and a contacting second detent member during rotation of the clamping ring in an unclamping direction relative to the first shell body, the angle B being not less than approximately 30°. Preferably the angle C is not less than approximately 40°.

The maximum displacement of the first and second detent members in a direction normal to the detent pitch circle during biased engagement between adjacent detented positions can be not greater than approximately 0.2S. The maximum displacement of the first and second detent members preferably is approximately 0.010.

The first detent members can be fixably connected on a first detent ring, the second detent members being fixed relative to the first shell body, the first detent ring being axially movable relative to the clamping ring, the biasing means comprising a cone-shaped spring washer coaxially supported relative to the first shell body. The spring washer can contact the first detent ring along a continuous annular contact path for uniform axial biasing of the detent members. The first detent ring can axially slidably engage an engagement surface, the engagement surface being fixed relative to the clamping ring. The connector preferably includes an adjustment ring threadingly engaging the clamping ring for adjustably preloading the spring washer. The clamping ring can be axially movable relative to the first shell body between an open position having an associated first biasing level of the spring washer when the clamping ring is in a disengaged position and a closed position having an associated second biasing level of the spring washer when the clamping ring is in a locked position, the second level being higher than the first level. The second detent members can be integrally formed with the first shell body. The connector can also include a second detent ring, the second detent members being formed in the second detent ring.

The connector can also include a second shell body for receiving the second set of contacts, the second shell body threadingly engaging the clamping ring, and stop means for rigidly spacing the first and second shell bodies in fixed axial relation in response to clamping engagement of the second shell body by the clamping ring. The stop means can include facing engagement surfaces of the first and second shell bodies. The biasing means can provide an axial biasing force at a first force level prior to engagement of the stop means, the force increasing to a second, higher force level subsequent to engagement of the stop means in response to continued advancement of the clamping ring relative to the second shell body.

Preferably the connector also includes a resilient member frictionally connecting the clamping ring and the first shell body for dampening vibrations therebetween. A pair of the resilient members can be axially located on opposite sides of the first and second detent members. The resilient members can be ring members, the resilient ring members in combination with the first shell body and the clamping ring sealingly enclosing the first and second detent members, and the spring means. An end ring can be connected to the clamping ring, one of the resilient ring members sealingly contacting the end ring.

DRAWINGS

These and other features, aspects, and advantages of the present invention will become better understood with reference to the following description, appended claims, and accompanying drawings, where:

FIG. 4 is a fragmentary lateral sectional view of an electrical connector incorporating an improved locking mechanism according to the present invention;

FIG. 5 is a fragmentary sectional view of the connector of FIG. 4 on line 5—5 therein;

FIG. 6 is a lateral detail diagrammatic view of a portion of the connector of FIG. 4.

DESCRIPTION

Figure 1:
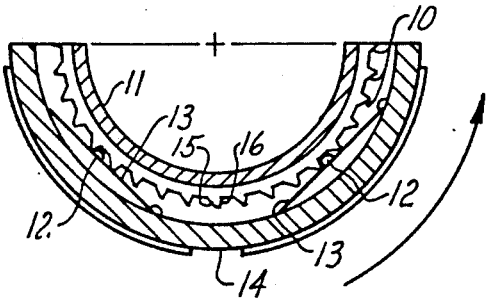
FIG. 1 (PRIOR ART)
FIG. 1 is an axial sectional diagrammatic view of a prior art connector locking device.

The present invention is directed to an electrical connector having an improved locking mechanism. With reference to FIGS. 4–5 of the drawings, a connector apparatus 20 according to the present invention includes a first shell assembly 22 having a threaded clamping ring 24 rotatably mounted concentric with a first shell member 26, and a second shell assembly 28 having a second shell member 30 that is threadingly engaged by the ring 24 when the shell assemblies 22 and 28 are in a coupled condition. Each of the assemblies 22 and 28 includes a contact assembly 32, designated pin assembly **32*p* and a socket assembly 32*s*, the contact assemblies 32 being interchangeably supported by the shell members 26 and 30, and having a suitable conventional configuration wherein one or more pins 33*p* of the pin assembly 32*p* engage a corresponding number of sockets 33*s* of the socket assembly 33*s*. The pin assembly 32*p* includes a resilient interfacial seal member 40 having respective button portions 41 that are each protruded by one of the pins 33*p* for sealing a corresponding socket opening 42 of the socket assembly 32*s*. As shown in FIG. 4, each of the button portions 41 is compressively displaced by the socket assembly 32s from a rest configuration (shown by the dashed line) to an intermediate displacement as indicated in the top half of FIG. 4 wherein the second shell assembly 28 is shown with the second shell member 30 spaced apart from a flange face surface 43 of the first shell member 26. The button portions 41 are further compressively displaced in a fully coupled position of the second shell assembly 28 wherein metal-to-metal contact is achieved between the second shell member 30 and the face surface 43 as shown in the bottom half of FIG. 4**.

According to the present invention, a set of first detent teeth 44 axially project within the clamping ring 24 in fixed angular relation thereto, for engagement with a corresponding number of second detent teeth 46 that are fixably located on the first shell member 26, a cone-shaped spring washer 48 biasing the first and second detent teeth 44 and 46 into simultaneous engagement. In an exemplary configuration of the apparatus 20 shown in FIGS. 4–6, the first detent teeth 44 are formed in one face of a first clutch plate 50, the plate 50 having three outwardly projecting lugs 52 that axially slidably engage a cap member 54 that is threadingly connected to the clamping ring 24, the cap member 54 being locked in a rigidly fixed position relative to the ring 24 subsequent to adjustment therewith as described below. The second detent teeth 46 are formed in one face of a second clutch plate 56 that is fixably connected to a flange portion 58 of the first shell member 26. The teeth 44 and 46 are located on an average pitch diameter P, having a width of engagement W in a direction normal to a tangent of the pitch diameter P.

In further accordance with the present invention, the clamping ring 24 is axially movable on the first shell member 26 by a distance T, the ring 24 being shown in a rearward, unclamped position in the top half of FIG. 4 wherein the ring engages the face surface 43 of the shell member 26. The distance T corresponds to an axial clearance between the first shell member 26 and the cap member 54, depending on the adjustment of the cap member 54. Similarly, an axial clearance G is provided between the lugs 52 and the cap member 54, and the spring washer 48 is confined within an axial spacing $D_1$, when the clamping ring 26 is in its rearward position, the detent teeth 44 and 46 being fully engaged. In the bottom half of FIG. 4, the clamping ring 24 is shown in its forward position wherein the cap member bears against the first shell member 26, the distance T representing an axial clearance between the clamping ring 24 and the face surface 43 of the first shell member 26, the spring washer 48 being confined within a spacing $D_2$, $D_2$ being smaller than $D_1$.

As best shown in FIG. 6, the detent teeth 44 and 46 are each formed with a trapezoidal profile, being joined end-to-end at a circular pitch or spacing S and having a flattened crown portion 60 of width c, the crown portions 60 defining respective crown surfaces 61a and 61b of the respective clutch plates 50 and 56 in planes perpendicular to a central connector axis 62 in the exemplary configuration of the apparatus 20 of FIGS. 4 and 5. It will be understood that the detent teeth 44 and 46, rather than forming a planar array as shown in FIG. 4, can alternatively be inclined for forming a cone-shaped array. In such case, the crown portions 60 would also lie in cone-shaped crown surfaces of the respective clutch plates 50 and 56.

As also shown in FIG. 4, the second clutch plate 56 is connected to the flange portion 58 of the first shell member 26 by at least one (preferably three) dowel pins 64, the pins 64 preferably having a solid configuration incorporating a conventional tapered groove (not shown) for locking engagement with the flange portion 58. The configuration of FIG. 4 also preferably includes at least one resilient member connecting the clamping ring 24 and the first shell member 26 for attenuating or dampening vibrations therebetween under severe environmental conditions. For this purpose, a pair of resilient rings 66, designated 66a and 66b in FIG. 4, are frictionally connected between the clamping ring 24 and the first shell member 26, the rings 66 being located axially for sealingly enclosing the spring washer 48 and the clutch plates 50 and 56. As further pointed out below, it has been discovered that the rings 66 materially improve the integrity of the connector apparatus 20 under severe vibration, both in the fully locked condition and in a partially locked condition. Also, the rings 66 advantageously provide for the retention of a suitable lubricant in the space containing the clutch plates 50 and 56, and the spring washer 48.

A first ramp surface 44a and a corresponding first ramp surface 46a of each of the teeth 44 and 46 have a flat profile, sloping at a first ramp angle A from the crown surfaces 61 in a direction compressing the spring washer 48 when the first clutch plate 50 is rotated with the clamping ring 24 in a first direction for clamping the second shell member 30 as indicated by the arrow in FIG. 6. Similarly, a second ramp surface 44b and a corresponding second ramp surface 46b of each of the teeth 44 and 46 have a flat profile, sloping at a second ramp angle B from the crown surfaces 61 in a direction compressing the spring washer 48 when the first clutch plate 50 is rotated with the clamping ring 24 in an opposite second direction for releasing the second shell member 30.

As further shown in FIG. 6, when the teeth 44 and 46 are fully engaged, the first ramp surfaces 44a and 46a have a length of engagement a in the direction of the spacing S, and the second ramp surfaces 44b and 46b have a corresponding length of engagement b, wherein $a+b=S-2c$. Accordingly, a maximum area of engagement between the clutch plates 50 and 56 can be expressed as $A_M=PW(a+b)/S$. When the clamping ring 24 is rotated in the clamping first direction, the rotation is resisted by an axial spring force F from the spring washer 48 that produces compressive loading between the first ramp surfaces 44a and 46a of the clutch plates 50 and 56, the force F being distributed over a forward area of engagement $A_F=PW(a-\sigma)/S$, where $\sigma$ is a circular distance of movement between the teeth 44 and 46 in the first direction relative to the fully engaged position, $\sigma$ being less than a. Conversely, when the clamping ring 24 is rotated in the second direction for releasing the clamping, the force F is distributed over a reverse area of engagement $A_R=PW(b-\sigma)$, $\sigma$ being less than b, taken in the second direction relative to the fully engaged position.

In a preferred configuration of the connector apparatus 20 for standard shell sizes 9 through 25, there are a large multiplicity M of the detent teeth 44 and 46, the number M ranging from approximately 50 in size 9 to in excess of 100 in size 25. Thus an angle $\Phi$ between adjacent fully engaged positions of the clutch plates 50 and 56 ranges from approximately 6° in shell size 9 to approximately 3° in shell size 25. When the connector apparatus 20 is configured generally as shown in FIG. 4, the average pitch diameter P ranges from approximately 0.6 inch in shell size 9 to approximately 1.6 inch in shell size 25. The teeth 44 and 46 are preferably formed with a tooth height H of not more than approximately 0.01 inch, the angle A being not greater than approximately 30°, the angle B being not less than approximately equal to the angle A. Further, the spacing S is preferably between approximately 0.03 inch and approximately 0.05 inch, the crown width c of the teeth 44 and 46 being preferably between approximately 0.003 inch and approximately 0.01 inch for providing a significant contact area between the crown portions 60 of teeth 44 and 46 when the clutch plates 50 and 56 are moved between adjacent engagement positions, while preserving an even larger area of engagement between the first ramp surfaces 44*a* and 46*a*, and between the second ramp surfaces 44*b* and 46*b* through a large portion of the rotation of the clutch plates 50 and 56 between the adjacent fully engaged positions. Correspondingly, a full engagement depth E between the first and second detent teeth 44 and 46 is preferably between about 0.007 inch and about 0.009 inch. Dynamically, the depth E is reduced by a distance $\epsilon$ during rotation of the clamping ring, where $\epsilon = \sigma \tan A$ in the first direction of rotation and $\epsilon = \sigma \tan B$ in the second direction of rotation. Similarly, a distance $\delta$ between opposite sides of the spring washer 48 decreases from $D_1$ and $D_2$, also according to the distance $\epsilon$. Moreover, a distance $\gamma$ between the lugs 52 of the first clutch plate 50 and the cap member 54 also decreases from the initial axial clearance G according to the distance $\epsilon$.

For example, when the spacing S is 0.04 inch and the crown width c is 0.006 inch, the maximum area of engagement $A_M$ is approximately 70 percent of the product of the average pitch diameter P and the width of engagement W. Even when the spacing S is reduced to 0.03 inch and the crown width c is increased to 0.01 inch, $A_M$ is generously greater than 30 percent of the product of P and W. More importantly, as the clamping ring 24 is rotated between adjacent fully engaged positions of the clutch plates 50 and 56 in the case of the spacing S being 0.04 inch and the crown width c being 0.006 inch, a dynamic area of engagement $A_\sigma$ between the detent teeth 44 and 46 is equal to or greater than approximately 0.1 times the product of P and W through approximately 60 percent of a detent engagement angle $\Phi$ between the adjacent positions. Even in the case where the spacing S is 0.03 and the crown width c is increased to 0.01 inch, the contact area remains at or above 0.05 times the product of P and W through 70 percent of that portion of the angle $\Phi$ wherein the first ramp surfaces 44*a* and 46*a*, or the second ramp surfaces 44*b* and 46*b* are in mating contact.

Figure 2:
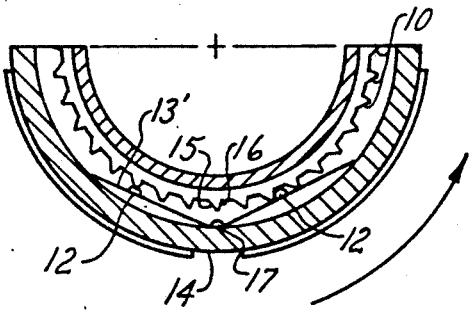
FIG. 2 (PRIOR ART)
FIG. 2 is a sectional diagram as in FIG. 1 showing another prior art locking device.
Figure 3:
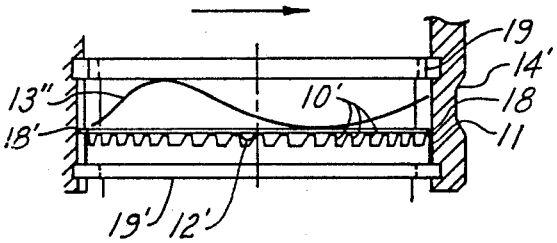
FIG. 3 (PRIOR ART)
FIG. 3 is a lateral sectional diagrammatic view showing another prior art locking device.

With these relationships in view, it will be apparent that the connector apparatus 20 of the present invention provides greatly improved locking and unlocking action over the prior art discussed above in connection with FIGS. 1–3, for a number of reasons. In a first respect, the spring force F is relatively large, being provided by the cone-shaped spring washer 48, such that the ramp angles A and B can be made relatively small. The small ramp angles, and especially the second ramp angle B being not substantially greater than the first ramp angle A, in combination with the flattened crown portions 60 of the detent teeth 44 and 46, greatly reduce wearing of the teeth 44 and 46 as compared with the prior art configurations of FIGS. 1–3.

In a second respect, the spring washer 48 provides at least some clamping force for avoiding rotational movement of the clamping ring 24 when the connector apparatus 20 of the present invention is subjected to vibration, even when the clamping ring 24 is not in its fully locked position.

In a third and very important respect, the present invention provides the required metal-to-metal contact between the second shell member 30 and the face surface 43 of the first shell member 26, while permitting rotation of the clamping ring 24 in the clamping direction, the further rotation being at least one multiple of the detent engagement angle $\Phi$ for insuring that the metal-to-metal contact is maintained even following a slight reverse rotation of the clamping ring 24 to a previously passed detent position.

Figure 7:
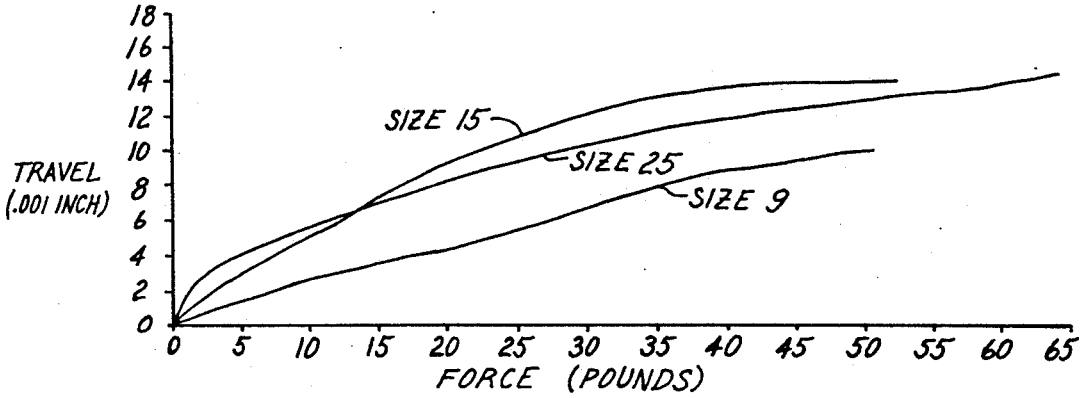
FIG. 7 is a graph of spring force test results of experimental prototypes of the apparatus of FIG. 4.

Experimental prototypes of the connector apparatus 20 have been fabricated and tested, with the testing continuing at present, the experimental connectors generally conforming to the configuration of FIGS. 4–6 except for the angled projection 68 on the first clutch plate 50 and the angled configuration of the cap member 54 that insures against inversion of the spring washer 48. The clutch plates 50 and 56 were machined from 300-series corrosion resistant steel and dry film lubricated for minimizing wear and for reducing the coefficient of friction between the mating parts. The number M of the detent teeth 44 and 46 each ranged from 54 in the shell size 9 to 120 in the shell size 25. The spring washers 48 were fabricated from beryllium copper, heat treated, in thicknesses of 0.005 inch in shell size 9, and 0.007 inch in shell sizes 15 and 25, the distance $D_1$ was nominally 0.042 inch, the respective spring washers 48 providing the axial force F as shown generally in FIG. 7. Following adjustment of the cap member 54, the threaded connection with the clamping ring 24 was staked for fixing the relationship between the parts.

Results of the tests for shell sizes 15 and 25 show that after 10,000 matings (clockwise) and 10,000 unmatings (counterclockwise) measured torque values were essentially unchanged. There was no visual evidence of particulate wear products under 10X magnification following final teardown. The engaging surfaces of the clutch plates 50 and 56 were smooth and burnished, with the features of the detent teeth 44 and 46 being well defined, without washout. The spring washer 48 exhibited no measurable dimensional changes after being subjected to $2.4 \times 10^6$ (2,400,000) deflections in the 20,000 complete revolutions in the shell size 25. Similarly, the spring washer 48 in the shell size 15 (M=90) had $1.8 \times 10^6$ (1,800,000) deflections. These tests correspond to 20 times the normal requirement for satisfactory operation during 500 matings and unmatings of the series III connector.

The clutch plates 50 and 56 are held under constant preload by the spring washer 48, the force F being uniformly distributed about the circumference of the first clutch plate 50. The torque required for rotation of the clamping is dictated by spring preload which is adjusted as described above by means of the threaded cap member 54. The spring washer 48 provides a consistent 360° axial preload on the clutch plates 50 and 56 which, when adjusted during assembly by means of the rear retaining plate/end cap, equates to the desired coupling and uncoupling torque. As the spring washer 48 exerts an equal load on the first and second detent teeth 44 and 46, the surface area contact, when engaged, is unparalleled when compared to the prior art configurations of FIGS. 1–3. The interlocking clutch plates 50 and 56 provide zero backlash even in an uncoupled state of the first shell assembly 22. When metal-to-metal contact occurs between the first shell member 26 and the second shell member 30, an internal preload override feature comes into play. This feature provides for additional axial spring load to be applied to the engaged clutch plates 50 and 56, after axial movement of the clamping 24 by the distance T, which is limited by a shoulder 70 on the first shell member 26 and a corresponding surface on the cap member 54. This internal stop prevents over-stressing the spring washer 48. In this fully coupled mode, there is no rotational movement of the coupling nut. Moreover, it has been discovered that after the metal-to-metal contact is achieved, the clamping ring 24 can be advanced typically two or three multiples of the detent engagement angle Φ for further assuring continued maintenance of the metal-to-metal contact under severe vibration conditions. Even in a partially-mated condition, when there is no metal-to-metal plug/receptacle contact, the spring washer preload prevents clutch plates 50 and 56 from disengaging and allowing the shell assemblies 22 and 28 to uncouple during high vibration conditions. The spring washer 48 minimizes rocking or skewing of the clamping ring 24 in a mated or free unmated state. This cannot be said of designs employing three-point contact wave springs or products utilizing peripheral ratchets.

The entire clutch mechanism is advantageously sealed by the dual rings 66. These rings, in addition to excluding foreign matter from the lock mechanism and permitting the clutch plates 50 and 56 to be coated with a retained lubricant as described above, substantially enhance the structural integrity of the connector apparatus 20 by damping vibrations of the clamping ring 24 relative to the shell members 26 and 30, as well as by augmenting its torque of rotation, especially in the partially locked condition of the connector. The connector apparatus 20 of the present invention does not rely on clip-type or spiral retaining rings to captivate the clamping rings 24 or provide a load-bearing surface during mating or unmating.

Although the present invention has been described in considerable detail with reference to certain preferred versions thereof, other versions are possible. For example, the second clutch ring 56 can be formed integrally with the first shell member 26, the second detent teeth 46 being preferably formed simultaneously by coining. Also the detent teeth—at least the second detent teeth 46 when formed integrally with the first shell member 26—can be formed of a high strength aluminum alloy which is preferably processed using known methods for producing a hard, wear resistant anodic coating. Further, the detent teeth 44 and 46 can be surface treated by other methods such as chrome or other plating and titanium nitriding. Therefore, the spirit and scope of the appended claims should not necessarily be limited to the description of the preferred versions contained herein.

What is claimed is:

1. A self-locking electrical connector comprising:

(a) a first shell body for receiving a first set of contacts;

(b) a threaded clamping ring rotatably coaxially supported on the first shell body for holding the first set of contacts in axial engagement with a second set of contacts;

(c) a multiplicity of first detent members supportively coaxially located in a fixed angular relation to the clamping ring;

(d) a multiplicity of second detent members supportively coaxially located in a fixed angular relation to the first shell body, the first and second detent members being simultaneously engagable on a detent pitch circle having an average detent pitch diameter P and having a detent engagement width W; and (e) biasing means for axially holding the first and second detent members in facing engagement, whereby a total surface contacting area of engagement between the detent members is at least 0.1 times the product of P and W, the biasing means providing a biasing force, the biasing force being distributed substantially uniformly among the first detent members, the first and second detent members being engagable in a multiplicity M of equally spaced positions having an angular spacing Φ and an equivalent tangential spacing S, wherein the total surface contact area of engagement is maintained at not less than approximately 0.05 times the product of P and W during rotational movement of the second detent members relative to the first detent members through an angle not less than half of the angular spacing Φ.

2. The connector of claim 1, wherein the first and second detent members engage at a first contact angle A between a tangent of the pitch circle and a first surface of contact between each first detent member and a contacting second detent member during rotation of the clamping ring in a clamping directly relative to the first shell body, the angle A being not greater than approximately 30°.

3. The connector of claim 2, wherein the angle A is not greater than approximately 20°.

4. The connector of claim 2, wherein the first and second detent members engage at a second contact angle C between a tangent of the pitch circle and a second surface of contact between each first detent member and a contacting second detent member during rotation of the clamping ring in an unclamping direction relative to the first shell body, the angle C being not less than approximately 30°.

5. The connector of claim 4, the angle C is not less than approximately 40°.

6. The connector of claim 1, wherein the maximum displacement of the first and second detent members in a direction normal to the detent pitch circle during biased engagement between adjacent detented positions is not greater than approximately 0.2S.

7. The connector of claim 6, wherein the maximum displacement of the first and second detent members is approximately 0.010.

8. The connector of claim 1, wherein the total surface contact area of engagement is not less than approximately 0.1 times the product of P and W through the angle not less than half of Φ.

9. A self-locking electrical connector comprising:

(a) a first shell body for receiving a first set of contacts;

(b) a threaded clamping ring rotatably coaxially supported on the first shell body for holding the first set of contacts in axial engagement with a second set of contacts;

(c) a multiplicity of first detent members supportively coaxially located in a fixed angular relation to the clamping ring;

(d) a multiplicity of second detent members supportively coaxially located in a fixed angular relation to the first shell body, the first and second detent members being simultaneously engagable on a detent pitch circle having an average detent pitch diameter P and having a detent engagement width W;

(e) biasing means for axially holding the first and second detent members in facing engagement, whereby a total surface contacting area of engagement between the detent members is at least 0.1 times the product of P and W; and (f) a pair of resilient members axially located on opposite sides of the first and second detent members, the resilient members being frictionally connected between the clamping ring and the first shell body for dampening vibrations therebetween.

10. The connector of claim 9, wherein the resilient members are ring members, the resilient ring members in combination with the first shell body and the clamping ring sealingly enclosing the first and second detent members, and the spring means.

11. The connector of claim 10, further comprising an end ring connected to the clamping ring, one of the resilient ring members sealingly contacting the end ring.

12. The connector of claim 10, further comprising a lubricant for the detent members, the lubricant being sealingly retained between the resilient ring members.

* * * * *